US011823821B2

(12) United States Patent
Tsang et al.

(10) Patent No.: US 11,823,821 B2
(45) Date of Patent: Nov. 21, 2023

(54) POLYMER VOLTAGE-DEPENDENT RESISTOR

(71) Applicant: Dongguan Littelfuse Electronics Company Limited, Dongguan (CN)

(72) Inventors: Chun-Kwan Tsang, Newark, CA (US); Jianhua Chen, Sunnyvale, CA (US); Yi-Hua Deng, Dongguan (CN)

(73) Assignee: Dongguan Littelfuse Electronics Company Limited, Dongguan (CN)

( * ) Notice: Subject to any disclaimer, the term of this patent is extended or adjusted under 35 U.S.C. 154(b) by 0 days.

(21) Appl. No.: 17/987,140

(22) Filed: Nov. 15, 2022

(65) Prior Publication Data

US 2023/0076752 A1 Mar. 9, 2023

Related U.S. Application Data

(62) Division of application No. 17/284,676, filed as application No. PCT/CN2018/110096 on Oct. 12, 2018, now Pat. No. 11,615,899.

(51) Int. Cl.

| | |
|---|---|
| ***H01C 7/10*** | (2006.01) |
| ***H01C 1/14*** | (2006.01) |
| ***H01C 17/065*** | (2006.01) |

(52) U.S. Cl.
CPC ..... *H01C 7/1006* (2013.01); *H01C 1/14* (2013.01); *H01C 17/06506* (2013.01)

(58) Field of Classification Search
CPC ..... H01C 7/1006; H01C 7/112; H01C 17/06526; H01C 17/06546; H01C 17/06553
See application file for complete search history.

(56) References Cited

FOREIGN PATENT DOCUMENTS

| | | | |
|---|---|---|---|
| CN | 104810423 A | * | 7/2015 |
| JP | 2014152735 A | * | 8/2014 |

OTHER PUBLICATIONS

CN 104810423 machine translation. (Year: 2015).*
JP 2014152735 machine translation. (Year: 2014).*

* cited by examiner

*Primary Examiner* — Kyung S Lee
(74) *Attorney, Agent, or Firm* — KDW Firm PLLC

(57) ABSTRACT

The present invention relates to a polymer voltage-dependent resistor (PVDR) in various physical forms and methods for manufacturing the varistor. The body of the PVDR is composed of a polymer matrix having a filler composed of doped zinc oxide particles, other semi conductive particles or metal particles uniformly distributed therein. Conductive electrodes may be affixed to the polymer matrix and electrical leads attached to the electrodes.

12 Claims, 8 Drawing Sheets

(a)

(b)

POLYMER VOLTAGE-DEPENDENT RESISTOR

CROSS REFERENCE TO RELATED APPLICATION

This application is a divisional of, and claims the benefit of priority to, U.S. patent application Ser. No. 17/284,676, filed Apr. 12, 2021, entitled "POLYMER VOLTAGE-DEPENDENT RESISTOR," which is a 371 application of PCT/CN2018/110096 filed Oct. 12, 2018 which application is incorporated herein by reference in its entirety.

FIELD OF THE DISCLOSURE

Embodiments relate to the field of circuit protection devices, and, more particularly, to a polymer-based voltage-dependent resistor and a method of manufacturing such a polymer-based voltage-dependent resistor.

BACKGROUND OF THE DISCLOSURE

Over-voltage protection devices are used to protect electronic circuits and components from damage due to over-voltage fault conditions. These over-voltage protection devices may include metal oxide varistors (MOVs) that are connected between the circuits to be protected and a ground line. MOVs have a current-voltage characteristic that allows them to be used to protect such circuits against catastrophic voltage surges. Because varistor devices are so widely deployed to protect many different types of apparatus, there is a continuing need to improve properties of varistors.

An MOV device (the terms "MOV" and "varistor" are used interchangeably herein unless otherwise noted) is generally composed of a ceramic disc, often based upon ZnO, an electrical contact layer that acts as an electrode, such as a Ag (silver) electrode, and a first metal lead and second metal lead connected at a first surface and second surface, respectively, where the second surface opposes the first surface. The MOV device is also provided with an insulation coating that surrounds the ceramic disc and other materials in many cases. An example of an MOV found in the present market includes a ceramic disc that is coated with epoxy insulation, which has a high dielectric strength.

The manufacturing process of the MOV consists of providing a zinc oxide powder mix with a small amount of metal oxide additive such as Bi2O3, SnO2, NiO, Al2O3 etc. and sintering at greater than 800° C. into ceramic parts. The ceramic varistors are made of an n-type semiconductor surrounded by insulating electric barriers.

After sintering, the varistor comprises ZnO crystals having a diameter of between 10 μm to 150 μm encapsulated by a grain boundary layer consisting substantially of the other inorganic oxide additives. The non-linear current-voltage characteristics of the varistor are dependent upon the potential barrier of the grain boundary layer. One problem with the conventional varistor manufacturing process is that the sintering process makes it difficult to control the size of the ZnO crystal grains and the grain boundary layer, and thus the operational characteristics of the device.

SUMMARY OF THE INVENTION

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In accordance with the present disclosure, a polymer voltage-dependent resistor (PVDR) is specified. In one embodiment, the PVDR may be formed into a disk-shaped structure comprising a cured polymer matrix having a varistor powder filler dispersed therein. The filler, in one embodiment, is an extrinsic semiconductor having nominally uniform grains which are dispersed evenly throughout the polymer matrix. Metal electrodes and electrical leads are connected to the disk-shaped structure using conventional methods. In another embodiment, the PVDR is formed as a multilayer device, having multiple layers of the polymer matrix having the filler dispersed therein with metal inner electrodes interleaved between the layers of the polymer matrix.

BRIEF DESCRIPTION OF THE DRAWINGS

FIG. 8(*b*) shows two different cross-sectional views of the multi-layer PVDR of FIG. 8(*a*) showing the positioning of the electrodes within the layers of the PVDR.

DETAILED DESCRIPTION

Figure 1:
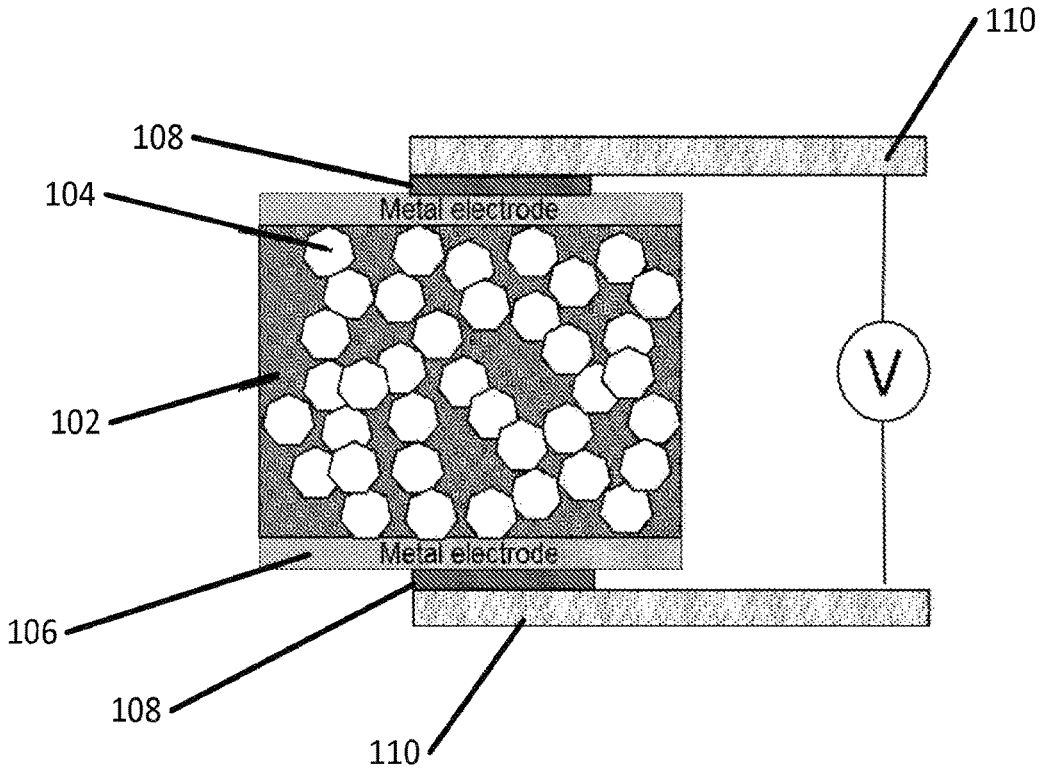
FIG. 1 is a schematic view of the primary embodiment.

The present invention will now be described more fully hereinafter with reference to the accompanying drawings, in which preferred embodiments of the invention are shown. This invention, however, may be embodied in many different forms and should not be construed as being limited to the embodiments set forth herein. Rather, these embodiments are provided so that this disclosure will be thorough and complete, and will fully convey the scope of the invention to those skilled in the art. In the drawings, like numbers refer to like elements throughout.

The present embodiments are generally directed to a polymer voltage-dependent resistor (PVDR) using a polymer-based filler infused with conductive particles, for example, doped zinc oxide or other semi-conductive particles, (such as SnO2 or SrTiO3), conductive polymers or metal particles. In a preferred embodiment, a monolithic polymer matrix infused with doped zinc oxide or other semi-conductive particles or metal particles forms the main body of the varistor. In another embodiment, a multi-layer varistor is formed by individual layers with a polymer matrix infused with doped zinc oxide, other semi-conductive particles or metal particles with electrically conductive inner electrodes between the layers of the polymer matrix.

FIG. 1 is a schematic view of a first embodiment of the invention. The main body of the PVDR is composed of a polymer matrix 102 having filler 104 comprising a conductive powder or semi-conductive powder dispersed therein. In another embodiment, filler 104 comprises doped metal oxide particles dispersed within the polymer matrix. Preferably, the filler 104 will be uniformly dispersed within the polymer matrix.

In a preferred embodiment of the invention, the doped metal oxide particles comprise zinc oxide particles having sizes averaging in the range of 1 μm to 100 μm. It is desirable that the size of the zinc oxide particles have a narrow distribution, having a standard deviation within about 10%, such as to provide a homogenous structure throughout the polymer matrix. However, in some embodiments, it may be advantageous to have a mixture of different sizes. In alternate embodiments, other metal oxides with combinations of other metal salts could also be used, including, for example, metal oxides or metallic ion salts or pure metal grains of Sn, Ti, Bi, Co, Mn, Ni, Cr, Sb, Y, Ag, Li, Cu, Al, Ce, In, Ga, La, Nb, Pr, Se, V, W, Zr, Si, or Fe.

The doping process entails adding metal oxides or metallic ion salts, or a combination of both, into the zinc oxide particle system to control the properties of the zinc oxide by a calcination process. In a preferred embodiment, an aluminum (III) salt binder solvent was added to the zinc oxide powder. In alternative embodiments lithium(I) salt or silver (I) salt may also be used. In other alternative embodiments, a metal oxide selected from the group comprising aluminum oxide, antimony oxide, cobalt oxide, manganese oxide, chromium oxide, tin oxide, nickel oxide and bismuth oxide may also be used. In preferred embodiments, the conductive material will comprise in excess of 95% by volume of the varistor powder.

To create the varistor filler 104, the metal oxide particles, the metal ion salt and water may be mixed using a ball mill. Thereafter, the mixture is calcinated in the furnace at approximately 900° C. for 4 hours. The size of the particles of doped zinc oxide can be controlled milling with the ball mill after the calcination step to obtain the target grain size.

Generally, the lower the size of the doped particles of metal oxide, the lower the varistor voltage rating.

The polymer matrix, in preferred embodiments, could be any thermosetting or thermoplastic polymer, or a combination thereof. In preferred embodiments, a silicone and epoxy mixture or polyethylene may be used. Alternatively, any polymer having suitable properties for use in a varistor may be used. In the mixing process, the thermoplastic polymer is melted at or above the melting point and the filler 104 is dispersed into the molten polymer 102. A mixing element, such as a rotating blade, mechanically shears the polymer and creates a mixing process. Once the mixing process is complete, the molten polymer-powder composite may be transferred to a high-pressure hot press to form a polymer film. For a thermosetting polymer, the filler is dispersed and well mixed with a mixing blade which mechanically shears the polymer and creates a mixing process. The thermosetting polymer may then be cured under heat, for example, by exposing the filler/polymer matrix composite to approximately 100° C. for approximately 1 hour, depending upon the specific properties of the polymer matrix.

The filler 104 can range from 10% to 70% by volume of the body of the PVDR, with the remaining volume being the polymer matrix. In a preferred embodiment, the volume of the filler 104 in the body of the PVDR is in the range of 60% by volume. The filler 104 acts as a variable resistor with a threshold voltage. The particles of the filer 104 form a conductive path through the body of the PVDR. The polymer matrix acts as a dielectric layer between the particles of the filler 104.

Figure 2:
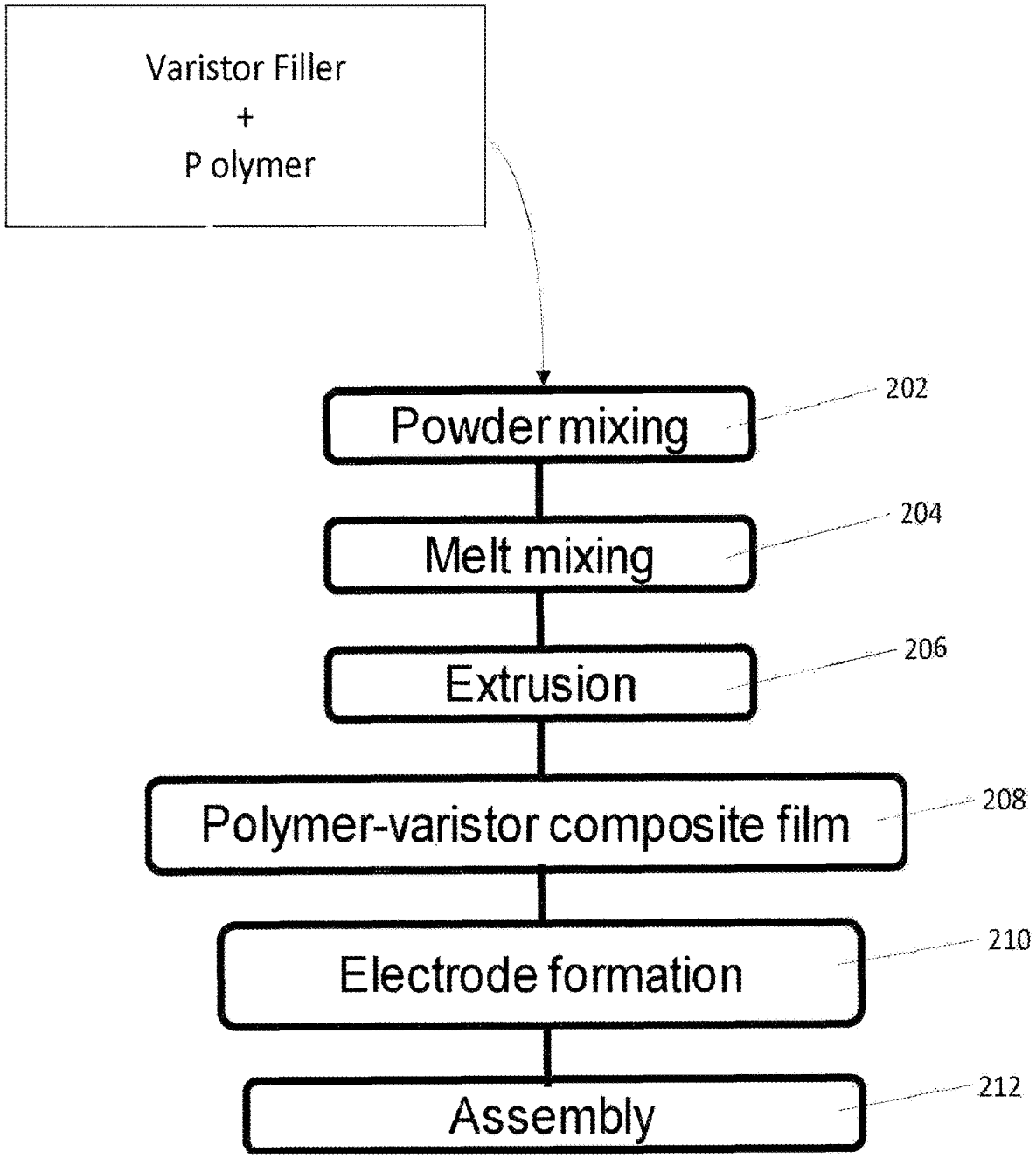
FIG. 2 is a flowchart showing the manufacturing process for a monolithic PVDR utilizing melt extrusion.
Figure 6:
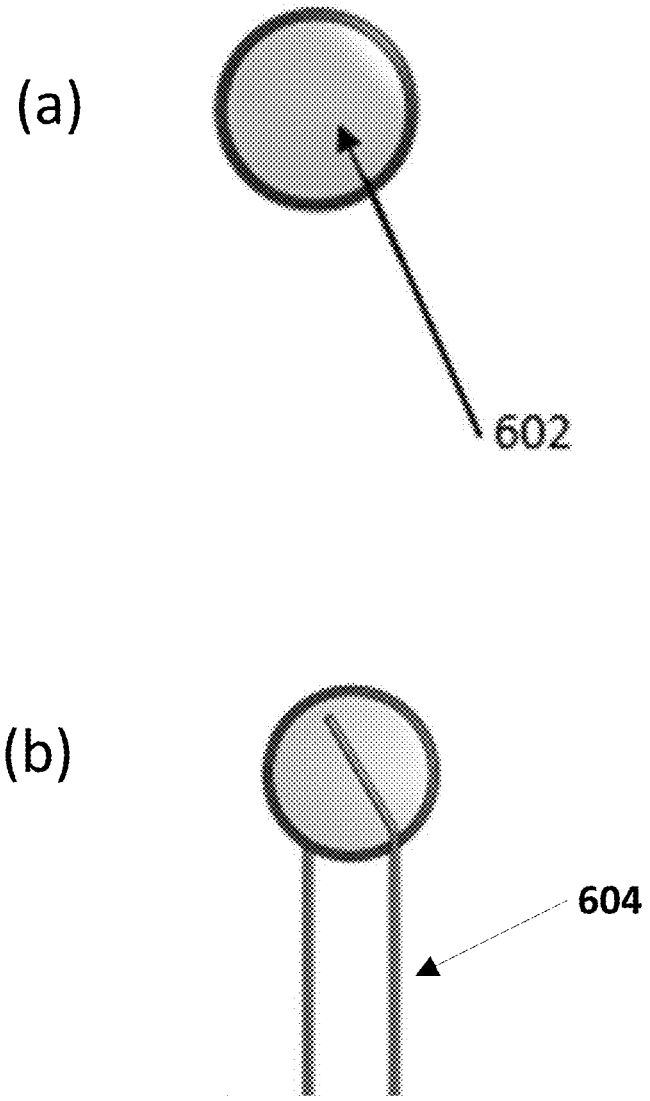
FIGS. 6(*a-b*) show several views of a first embodiment of a monolithic PVDR with and without metal leads manufactured in accordance with a first manufacturing method.
Figure 7:
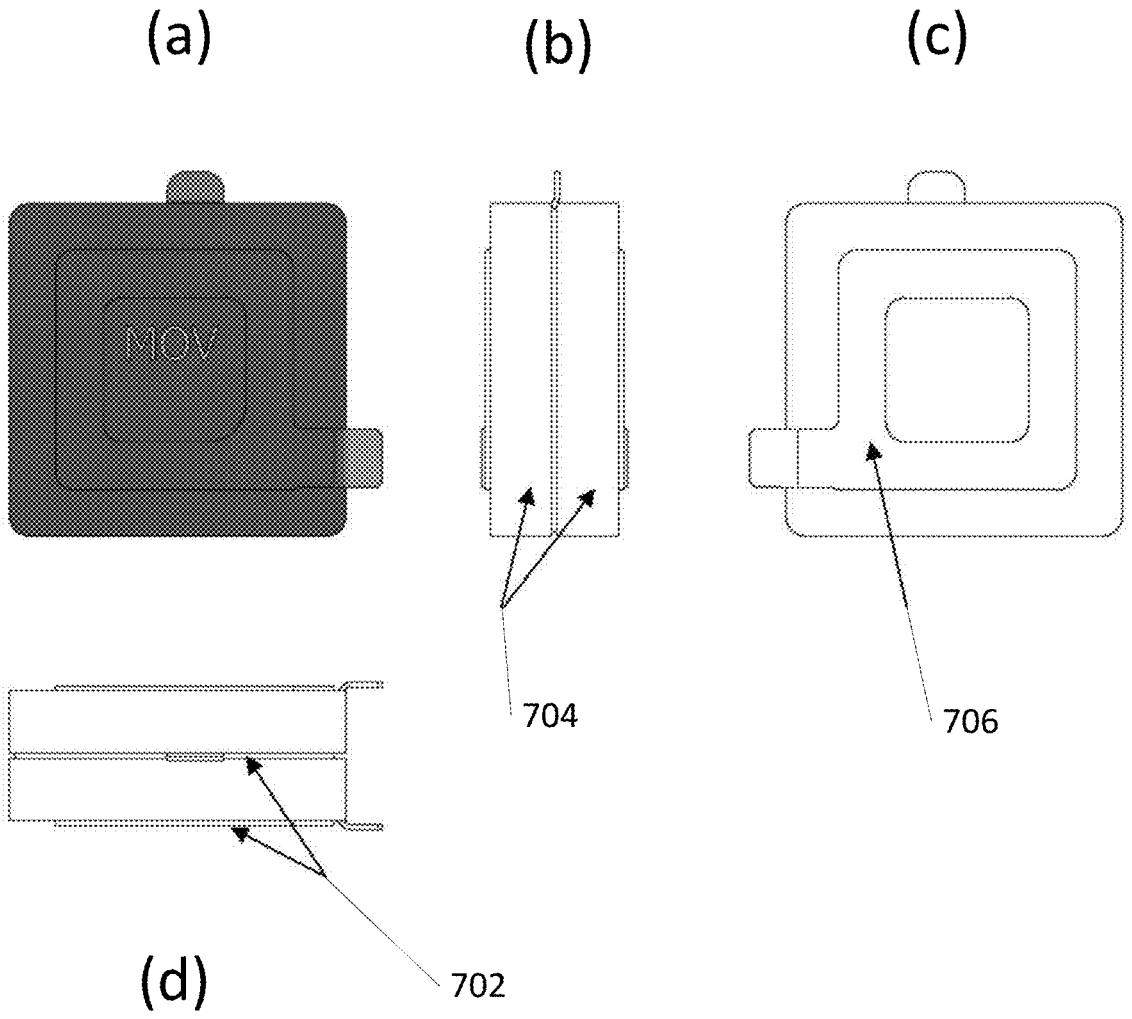
FIGS. 7(*a-d*) show several views of a second embodiment of a monolithic PVDR manufactured in accordance with a first manufacturing method.

FIG. 2 shows the manufacturing process for manufacturing a monolithic PVDR as shown, for example, in FIGS. 6(*a-b*) and FIGS. 7(*a-d*). The process starts with a mixture of the filler 104, (i.e., doped zinc oxide particles, other semi conductive particles or metal particles), prepared as described above, and dry polymer 102. At 202, the filler 104 and polymer 102 are mixed and, at 204 the mixture is heated to melt the polymer 102 and further mixing occurs. At 206, the mixture of the filler 104 and melted polymer 102 is extruded to form a polymer-varistor composite film of the appropriate size and shape. Thereafter, electrodes are formed at 210. And at 212, the PVDR is assembled.

FIGS. 6(*a-b*) show a first embodiment of a PVDR manufactured in accordance with the process of FIG. 2. The electrodes, shown in FIG. as reference number 602, are preferably composed of a foil comprising silver, copper, nickel, aluminum, or zinc. The electrodes may be affixed to the polymer-varistor composite film using a paste or epoxy of the same material as the foil. Metal leads 604 are thereafter attached to the electrodes, as shown in FIG. 6(*b*). The paste or epoxy may be, for example, commercially available silver or aluminum epoxy paste. The metal leads may be, for example, copper clad steel (CCS) or copper clad aluminum (CCA) wires, a nickel foil may be placed between the polymer matrix and the metal electrode, to provided better adhesion between the polymer matrix and the electrode. The nickel foil may be a nodular type nickel foil with a rough surface, having nodules to provide good adhesion between the polymer and electrode.

FIGS. 7(*a-d*) show a second embodiment of a PVDR manufactured in accordance with the process of FIG. 2. In this embodiment, electrodes 702 are placed as shown in the figure. As before, the electrodes are preferably a foil composed of silver, copper, nickel, aluminum, or zinc, and are fixed using a paste or epoxy of the same material as the foil. The PVDR, in this embodiment, uses two polymer-varistor composite films 704. The metal leads are formed as metal straps 706, preferably composed of CCS or CCA plate or tin-coated copper plate.

Figure 3:
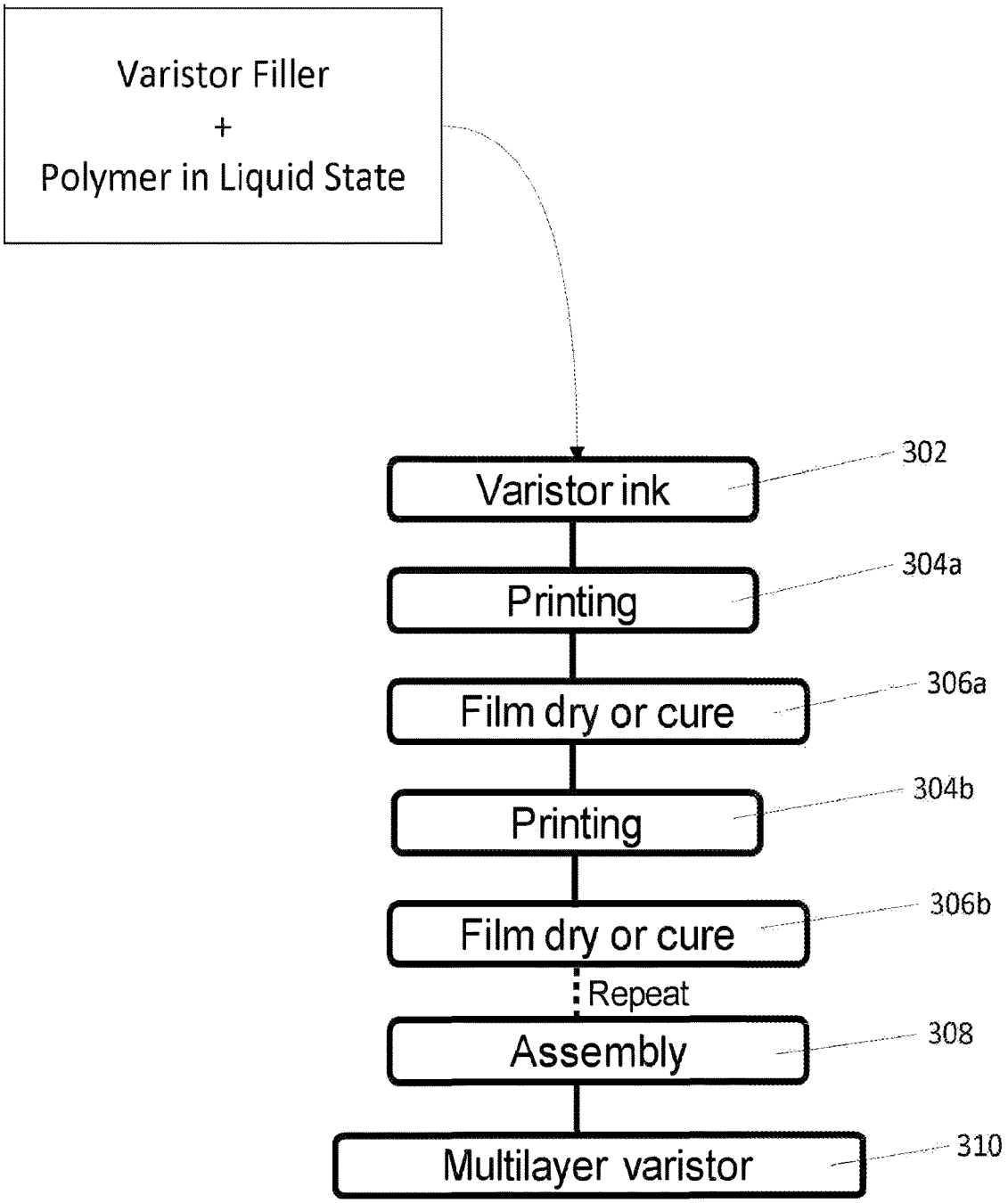
FIG. 3 is a flowchart showing the manufacturing process for a multilayer PVDR using a casting process.
Figure 8:
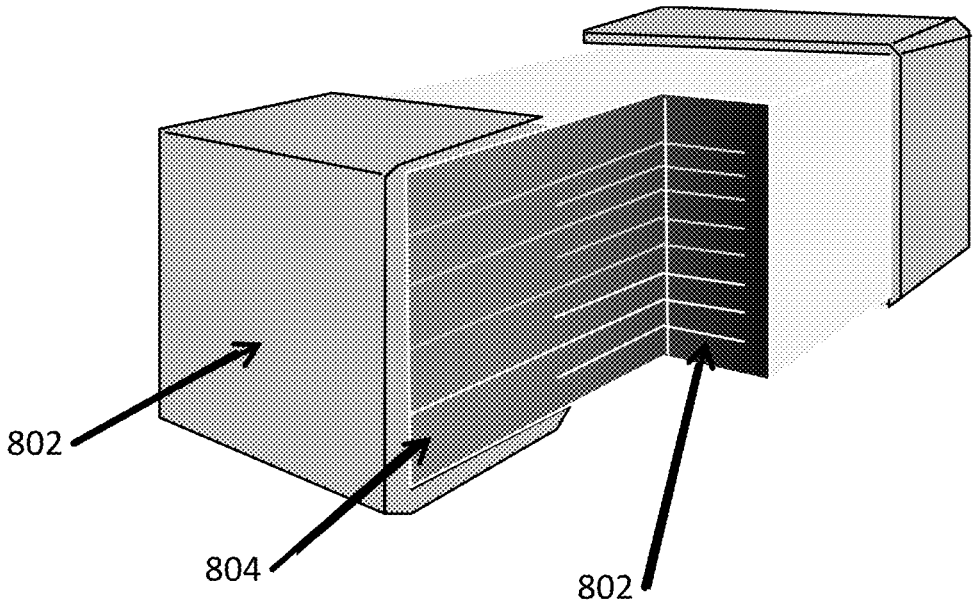
FIG. 8(*a*) shows a cutaway view of a multi-layer PVDR manufactured in accordance with the second manufacturing method.
Figure 8:
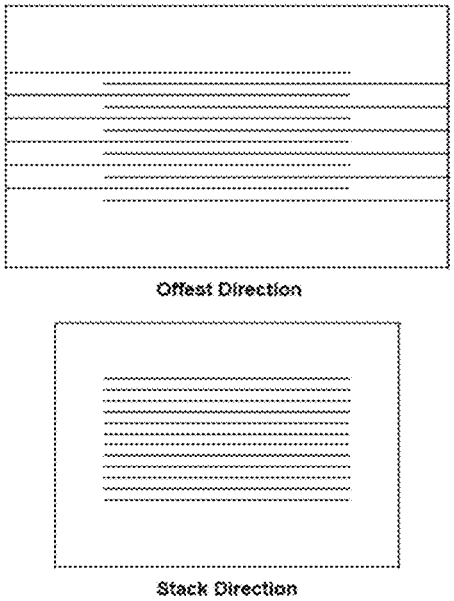

FIG. 3 shows the manufacturing process for a multi-layer PVDR. In this embodiment, the filler 104 (i.e., doped zinc oxide particles, other semi conductive particles or metal particles) is added to polymer 102 in liquid state to form a varistor ink 302. The varistor ink then may be printed into multiple layers by printing at 304*a* and along the film to dry or cure at 306*a*. Additional layers may be formed by repeating the printing step 304*b* . . . n and drying or curing step 306*b* . . . n as many times as desired. Assembly occurs at 308, resulting in a multilayer PVDR 310, as shown in FIG. 8(*a*). The assembly step 308 comprises interleaving metal inner electrodes 802 between the layers of the polymer composite 804. End termination caps 806 are thereafter formed on the polymer composite 804. The end termination caps 806 and the metal inner electrodes 802 are preferably composed of any one of silver, copper, nickel, aluminum or zinc foils and/or pastes or epoxies formed of silver, copper, nickel, aluminum or zinc. FIG. 8(*b*) shows the inner electrodes in both the stacked configuration and the offset configuration.

Figure 4:
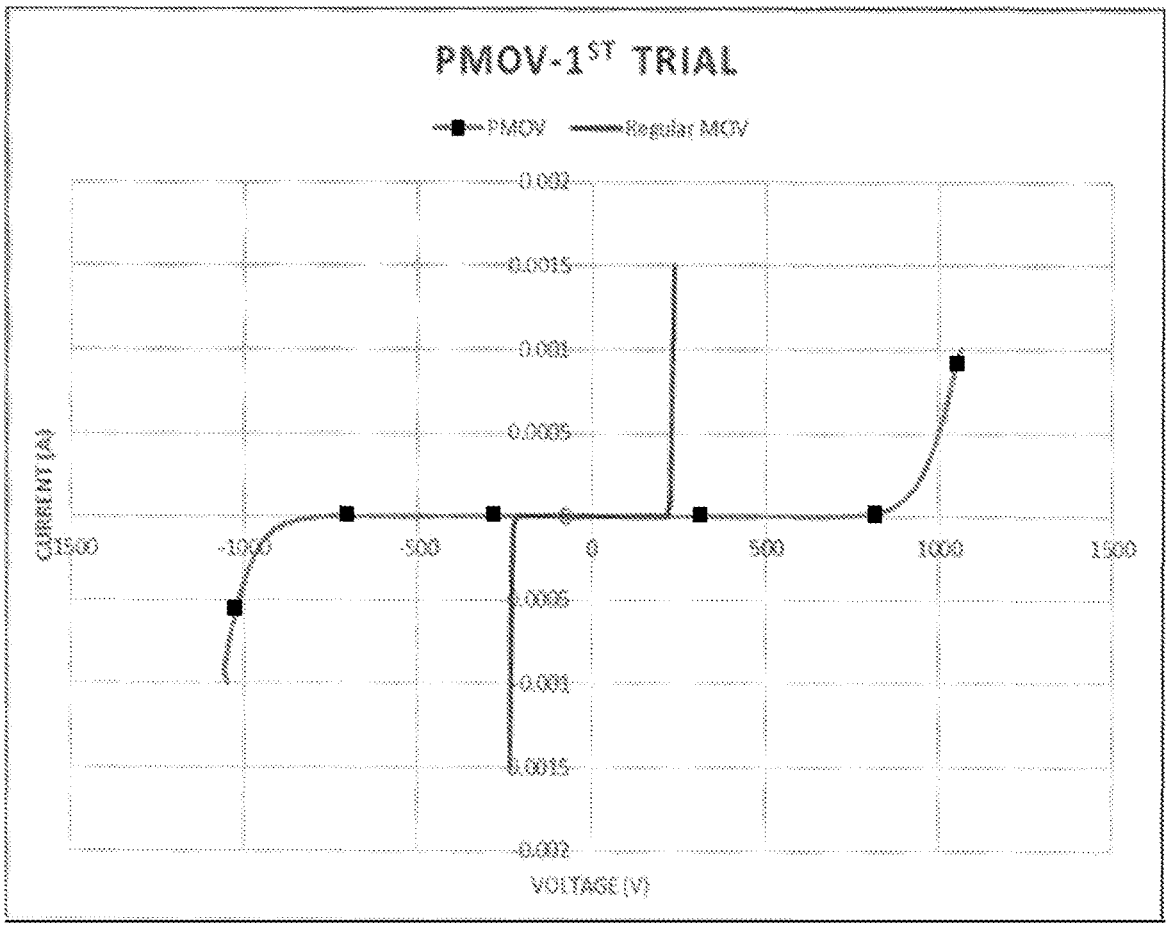
FIG. 4 is a graph showing the voltage-current characteristics of a PVDR versus a prior art varistor manufactured using a traditional manufacturing process.
Figure 5:
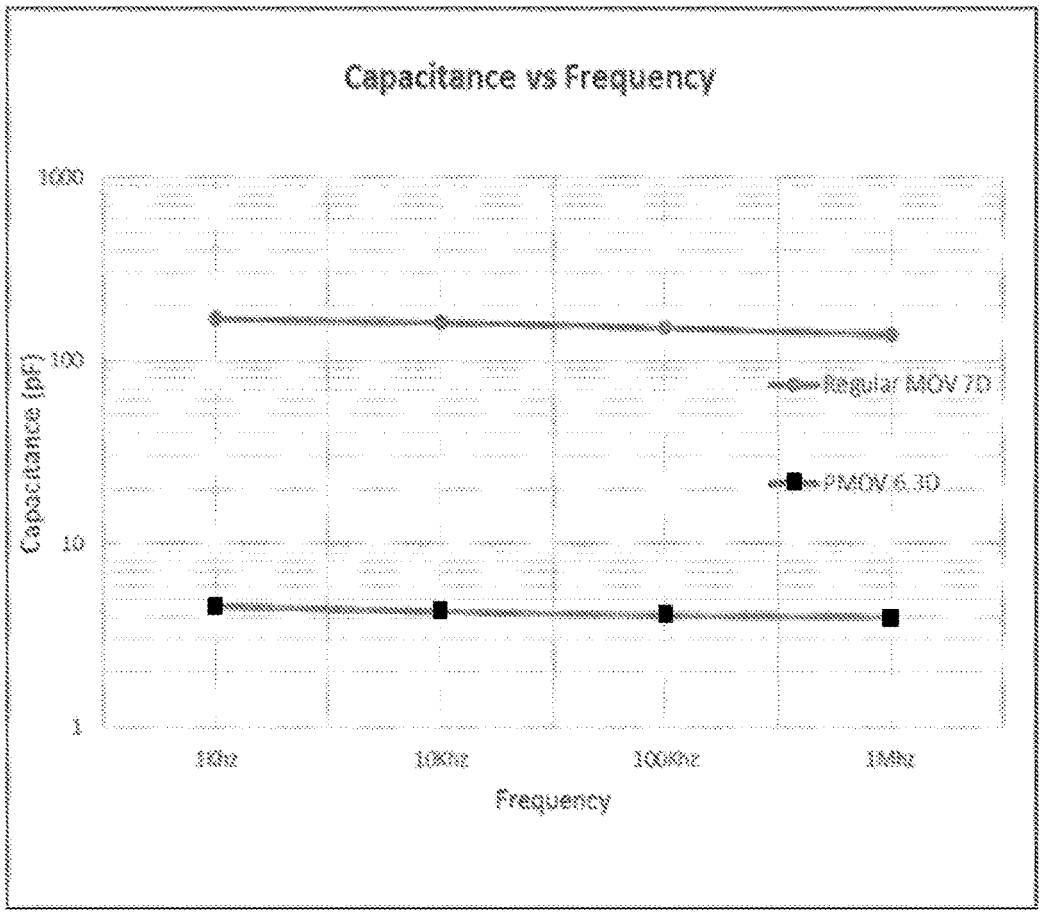
FIG. 5 is a graph showing capacitance versus frequency for a PVDR versus a prior art varistor.

FIG. 4 is a graph showing the voltage-current characteristics of a PVDR as opposed to a traditional ceramic type varistor. The PVDR shown in FIG. 4, was formed as a disk-style varistor as shown in FIG. 6 having a diameter of 6.32 mm and a thickness of 1.2 mm. The ceramic type varistor to which it is compared has diameter of 7 mm and a thickness of 1.2 mm. The PVDR was formed as 60% by volume of doped zinc oxide and 40% by volume of polyethylene as a polymer matrix. FIG. 5 shows the PVDR having a low capacitance as compared to a prior art ceramic varistor. In preferred embodiments, the voltage rating of the PVDR will be in the range of 10 V/mm to 2000 V/mm. The voltage rating may be varied based on the thickness of the PVDR, the particle size and the dopant. The PVDR provides high Ev (more than 1000V/mm or 2000V/mm), and the manufacturing process is simpler and more effective than that of a traditional ceramic based varistor, having advantages including low temperature forming, more accurate voltage design, smaller devices, and a base metal electrode.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed:

1. A method of manufacturing a multi-layered, polymer voltage-dependent resistor comprising:

stacking a plurality of layers, each layer manufactured by a process comprising:

mixing a varistor filler comprising doped zinc oxide particles, semi conductive particles or metal particles;

mixing the filler with a dry polymer;

heating the polymer/filler mixture to a molten state;

extruding the polymer/filler mixture to a composite film; and forming electrodes on two opposing outer surfaces of the extruded film; and attaching metal leads to the electrodes from each layer;

wherein the filler comprises 10% to 70% by volume of each layer.

2. The method of claim 1 wherein the filler comprises a mixture of zinc oxide particles zinc oxide particles mixed with metal oxides, metallic ion salts, or a combination of metal oxides and metallic ion salts.

3. The method of claim 2 wherein an aluminum(III) salt lithium(I) salt or silver(I) salt is added to the zinc oxide particles.

4. The method of claim 2 further comprising heating the filler prior to mixing with the polymer.

5. The method of claim 1 wherein the filler has a size distribution having a standard deviation within about 10%.

6. The method of claim 1 wherein the filler is substantially uniformly dispersed within the polymer.

7. The method of claim 1 wherein the filler further comprises an additive comprising a metal oxide other than zinc oxide.

8. The method of claim 1 wherein the electrodes comprise a foil composed of silver, copper, nickel, aluminum or zinc.

9. The method of claim 8 wherein the metal leads are attached to the electrodes using a conductive paste or epoxy.

10. The method of claim 1 wherein the metal leads are composed of copper-clad steel or copper-clad aluminum.

11. The method of claim 1 further comprising placing a nickel foil between the composite film and the electrode.

12. The method of claim 11 wherein the nickel foil has a rough surface defining nodules.

* * * * *